United States Patent [19]

Rairden, III

[11] Patent Number: 4,681,772

[45] Date of Patent: Jul. 21, 1987

[54] METHOD OF PRODUCING EXTENDED AREA HIGH QUALITY PLASMA SPRAY DEPOSITS

[75] Inventor: John R. Rairden, III, Schenectady, N.Y.

[73] Assignee: General Electric Company, Schenectady, N.Y.

[21] Appl. No.: 859,537

[22] Filed: May 5, 1986

[51] Int. Cl.[4] ..... C23C 15/00

[52] U.S. Cl. ..... 427/34; 204/164

[58] Field of Search ..... 427/34; 204/164; 219/121 PY

[56] References Cited

U.S. PATENT DOCUMENTS

| | | | |
|---|---|---|---|
| 3,140,380 | 7/1964 | Jensen | 427/34 |
| 3,283,117 | 11/1966 | Holmes et al. | 427/34 |
| 4,492,845 | 1/1985 | Kljuchko et al. | 427/34 |

*Primary Examiner*—John F. Niebling

*Attorney, Agent, or Firm*—Paul E. Rochford; James C. Davis, Jr.; Paul R. Webb, II

[57] ABSTRACT

Dense layers of metals and compounds may be formed on a receiving surface of simple geometry by use of a plasma spray technique in a vacuum chamber in which multiple guns are used simultaneously to deposit material in overlapping areas.

6 Claims, 8 Drawing Figures

DATA SHOWN: % DENSITY AS-DEPOSITED / % DENSITY AFTER HEAT TREATMENT (2hr, 1250°C)

DATA SHOWN: % DENSITY AS-DEPOSITED / % DENSITY AFTER HEAT TREATMENT (2hr, 1250°C)

METHOD OF PRODUCING EXTENDED AREA HIGH QUALITY PLASMA SPRAY DEPOSITS

RELATED APPLICATIONS

This application relates to copending application Ser. No. 859,536 filed simultaneously herewith. The text of this copending application is incorporated herein by reference.

BACKGROUND OF THE INVENTION

The present invention relates to a method and means for forming dense articles and articles of irregular configuration by plasma deposition. More particularly it relates to a low pressure plasma deposition process and apparatus by which more dense cohesive deposits, which may have intricate shapes are formed on receiving surfaces.

The state of the art of low pressure plasma deposition makes possible the deposit of a dense layer in the central portion of the target area within the sweep of a plasma flame. For a particular apparatus and set of operating parameters this central region will be approximately 20 to 40 sq. cm. in diameter and the deposit densities approach about 100% particularly if the deposited layer is given a densification heat treatment. Also typically the spray deposit surrounding the central region, and particularly in a fringe region, is less dense and in fact becomes extremely porous outside an area of about 100 sq. cm. The porous outer zone is not densified to even 97% of theoretical density and material with density of less than 97% has poor combinations of physical properties, in particular, poor tensile properties.

To put this in perspective and using circular areas a designated central area of dense deposit of 20 square centimeters covers an area having a diameter of about 5 centimeters. If only the central area is dense as deposited then only a small fraction of the whole deposit is dense. 40 square centimeters is included within a circle having a diameter of about 7.1 centimeters and the 100 square centimeter area is included within a circle having a diameter of about 11.3 centimeters.

Under present technology if the size of the deposit to be made from a plasma gun is larger in at least one dimension than the dense region of a spray pattern, then it is necessary to use either a gun motion or substrate motion, or both, to cover the larger area. This motion leads to a deposit that is some combination of dense and porous. The effect of increasing the deposit size on the tensile and ductility properties of the deposit leads to the conclusion that larger area deposits are less dense and are weaker in the as-deposited state.

Plasma spray deposits have been formed from numerous powdered starting materials including powders of nickel base superalloys.

It has been found that the ductility values of deposits which have less than a 97% density after heat treatment, as, for example, at about 1250° for nickel base superalloys for a suitable time, is low.

SUMMARY OF THE INVENTION

Accordingly one object of the present invention to provide a method by which larger area dense surface coatings can be made through low pressure plasma deposition with good properties in the as deposited layer.

Another object is to provide an apparatus which permits dense deposits to be made over larger areas through low pressure plasma deposition techniques.

Another object is to provide a method by which dense deposits can be made on a non-planar surface of relatively larger dimensions.

Still another object is to provide more uniformly dense deposits made by low pressure plasma deposition techniques over a relatively large area.

Other objects will be in part apparent and in part pointed out in the description which follows.

In one of its broader aspects the objects of the invention may be achieved by providing at least two guns in a low pressure plasma spray chamber and depositing material simultaneously from the guns in patterns which overlap as the deposit is being made. The two guns are mounted in the chamber to provide a trajectory for the plasma flame which is incident on a receiving surface in an overlapping pattern.

I have found that where a first plasma gun is employed to make a plasma spray deposit in an area and this deposit is normally porous and a second gun is employed to make a deposit in the same area, and this second deposit would normally be porous, that surprisingly a fully dense deposit can result if two guns are used simultaneously to produce what would individually be porous single gun deposits.

Where a still larger pattern is sought the use of more than two guns simultaneously is part of the method of the present invention.

BRIEF DESCRIPTION OF THE DRAWINGS

The description which follows will be understood more clearly if reference is made to the accompanying drawings in which.

DETAILED DESCRIPTION OF THE PRESENT INVENTION

Figure 1:
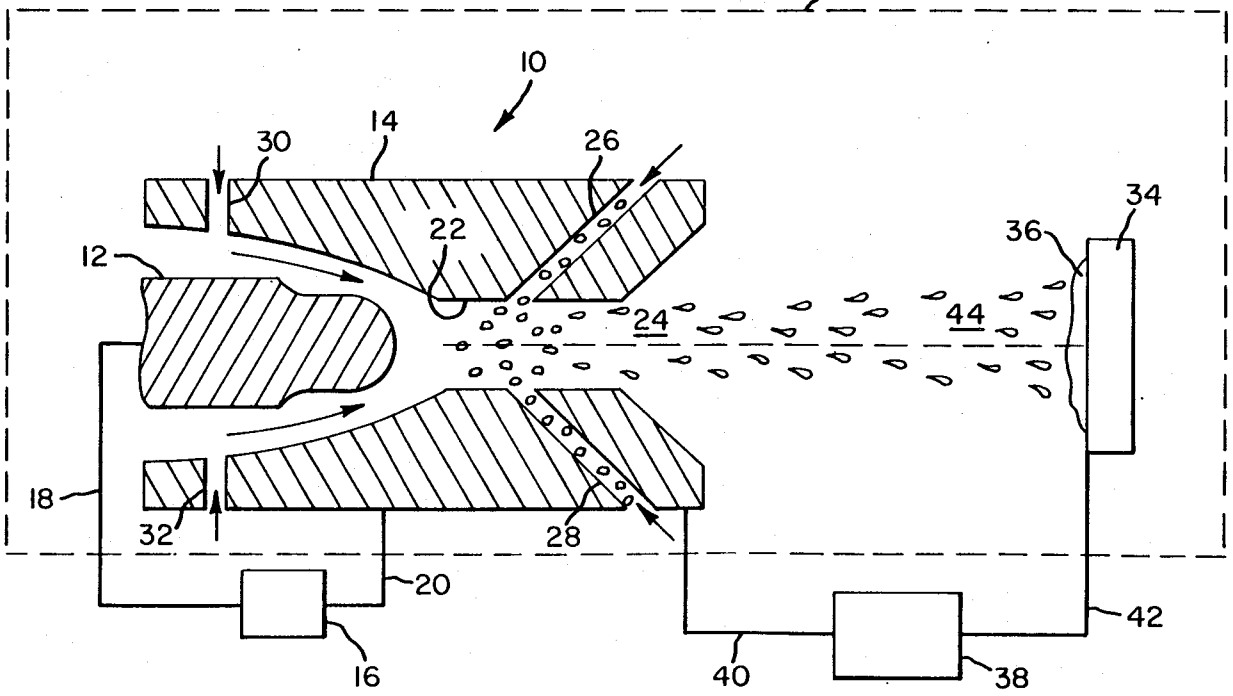
FIG. 1 is a schematic rendering of a low pressure plasma deposition apparatus with particular emphasis on the plasma gun and its relation to the target.

A plasma spray gun 10 enclosed within a low pressure enclosure 8 is shown schematically in FIG. 1. The gun has a central cathode 12 which is spaced from an annular anode 14. A working voltage is established between the anode and cathode by a power supply 16 connected respectively to the cathode and anode by conductors 18 and 20. The anode has a central aperture 22 through which a stream of particles shown schematically at 24 are passed. The particles are supplied to the aperture 22 through the supply ports 26 and 28 spaced around the anode 14. A flow of gas is introduced through the ports 30 and 32 and the gas passes through the annular space between cathode 12 and anode 14.

The gas is introduced through port 30 and 32 from a source not shown and its flow through the annular space between the cathode and anode permits a plasma arc to be established based on the imposition of a suitable activating power and arc between the anode and cathode. The sweep of the gas through the annular clearance and through the orifice 24 carries the particles introduced into the orifice from the orifice and toward a target 34 spaced from the arc plasma spray gun 10. A deposit of material 36 is formed on the target 34 which serves as a substrate for the layer of deposited material 36.

The gun and target are enclosed within a low pressure enclosure 8 shown by a dashed line in FIG. 1. Appropriate gas and powder supply means supply the gun from reservoirs external to the enclosure 8.

A suitable power supply 38 is provided to maintain a desired voltage between gun 10 and target 34 and to impose on the target a desired change in voltage as may be suitable for operation of the gun and deposit of a desired layer 36. Conductors 40 and 42 . connect the power source 38 to the gun 10 and target 34, respectively. While the plasma arc is established between the anode and cathode a very high temperature is generated of the order of 10,000°to 20,000° C. and the energy of this plasma is sufficient to cause a fusion of the particles introduced into orifice 24. The molten particles are carried on the plasma jet spray from the gun 10 to target 34 in the stream 44 as illustrated.

Where a deposit is made with the low pressure plasma technique using a plasma gun such as 10 onto a relatively large surface such as 34 the surface itself is preferably heated. The heating may be by means of the heat from the plasma gun itself or may be from an independent source. Where a single gun is employed of about 80 kilowatt plasma spray energy the maximum area of a sample which can be maintained at about 900° C. is about 1000 sq. cm. 1000 sq. cm. is contained within a generally circular area of about 36 centimeters diameter.

Two EPI model 03-CA plasma spray guns with 03-CA-80 anodes were mounted side by side in a water cooled low pressure chamber which had dimensions of 114 centimeters in diameter and 137 centimeters in length. Within this structure a gun mounting bracket was disposed so that two guns could be mounted to the bracket as close as 9 centimeters apart and these two guns could be angled so that the aim point of each gun could be varied widely through a control mechanism exercised from the exterior of the chamber.

The apparatus was also equipped to hold substrate mandrels measuring approximately 15.2 centimeters by 25.4 centimeters with a thickness of 0.32 centimeters. The mandrels used were copper sheet. After a deposition of a layer by the low pressure plasma method on the surface of the mandrel, the substrate mandrels were removed by selective chemical dissolution.

The powder which was used in plasma-forming these layers was a −400 mesh metal powder of alloy IN-100 obtained from Homogeneous Metals, Clayville, N.Y.

After removal of the mandrel the deposited layer was cut into conventional test dumbbell shapes as conventionally used in conducting tensile tests and having end pieces and a centerpiece of approximately 0.203 centimeters in width. Thickness was approximately 0.157±0.0025 centimeters.

Figure 2:
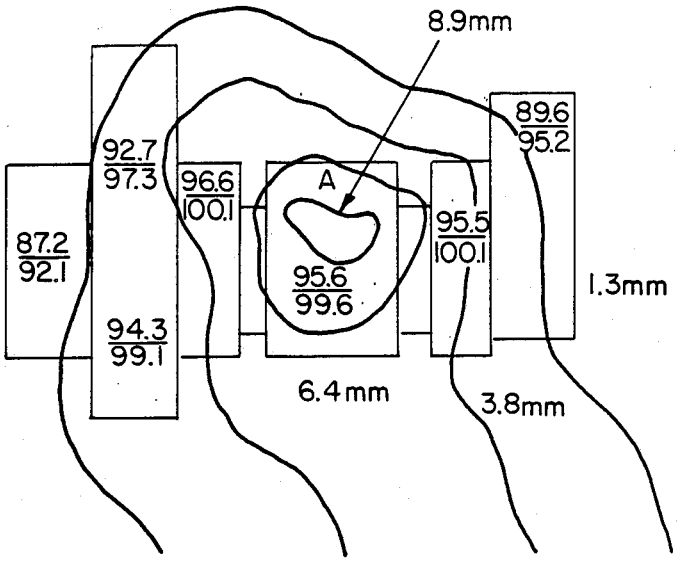
FIG. 2 is a contour map of a plasma spray deposit recording deposit thickness and the density at various locations.

Referring to FIG. 2 the results of forming a deposit on a receiving surface from a single plasma spray gun are illustrated. The contour lines illustrate the pattern of the deposit of even depth. From the legend of FIG. 2 the density figures for each sample of the deposit enclosed within the marked rectangle is evident. In the center the deposit density is 95.6 and this is raised to 99.6 by a 2 hour heat treatment at 1250° C.

However the density of the two outer rectangles is low both in the as deposited condition 87.2 and 89.6 respectively, and after anneal 92.1 and 95.2 respectively. Specimens with such low density are also found to have low tensile strengths.

Figure 8:
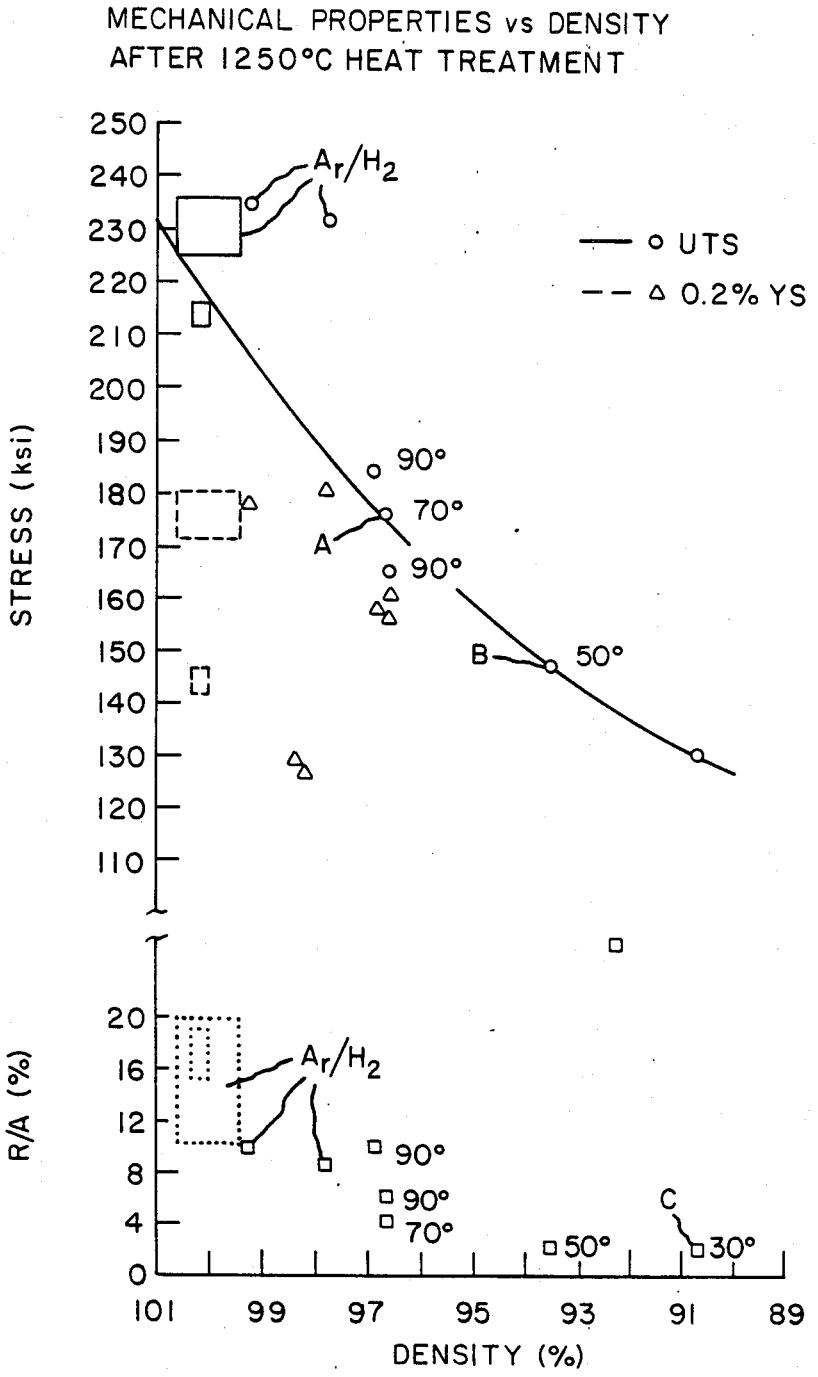
FIG. 8 is a set of two graphs the upper part of which is a plot of stress against density and the lower portion of which is a plot of the reduction in area of a tensile specimen against density and which relates to ductility or extensibility of the samples.

The significance of the different densities of material which is deposited by the rapid solidification plasma deposition as practiced according to this invention may be made clearer by reference to the data which is incorporated in FIG. 8. In FIG. 8 the density is plotted as the abscissa with decreasing density from the ordinate line. The ordinate is plotted in two sections separated by the two parallel wavy lines which indicate a gap in the ordinate scale. The lower scale designates the ratio of the original cross sectional area of a tensile bar specimen to the final cross sectional area of the tensile bar specimen just before it separates into two halves when the ultimate tensile strength is reached, given as a percentage figure of the original specimen diameter (R) to the final specimen diameter (A). For example, in the lower left hand corner of the Figure a data point appears at approximately 99% density and 9% reduction in area. The significance is that the sample corresponding to that data point has an area at the narrow point of the tensile test specimen which has been reduced by 9% of its original dimensions when the specimen was pulled into two segments.

The upper plot of FIG. 8 shows the strength in ksi of a specimen as the ordinate plotted against the percentage of density of the respective samples. The percentage density is on the same scale as is used in the lower portion of FIG. 8. For example, a round data point at 180 and 97% indicates an ultimate tensile strength of about 180 ksi for a material having a density of about 97%.

A triangular data point located at the same position would show that a test specimen having a density of about 97% displayed a yield strength of approximately 180 ksi using the standard yield strength tests and indicators.

The box at the upper portion of the FIG. 8, shown in the solid line, is a region of numerous data points and the enclosure within the box is intended to signify that numerous data points were taken within the indicated range. The values shown are for the ultimate tensile strength of the material tested.

A corresponding box in dashed lines in the 170–180 ksi range represents numerous corresponding data points showing the yield strength of the materials tested. In other words for the materials which were tested and which have values of ultimate tensile strength (UTS) in the range of 230 ksi, these same samples had yield strengths (YS) in the range of 170 to 180 ksi.

Similarly the smaller rectangular box at about 213 ksi defines an area signifying multiple test points of the ultimate tensile strength (UTS) of various samples. The dashed box at about 145 ksi signifies the corresponding yield strengths (YS) of the same samples plotted in the solid box above at 213 ksi.

Further the data within the solid box at about 230 ksi were samples taken from the sweet spot of each sample tested. The sweet spot terminology as used herein means a dense region of a deposit of plasma sprayed material which is the result of a deposit from a stationary gun onto a stationary substrate with no relative motion therebetween. For example the data collected for the upper box of FIG. 8, particularly the solid line box at about 230 ksi, was a measurement made from a sweet spot sample and one which had been prepared using a mixture of argon and hydrogen in the gun from which the deposit was emitted. The hydrogen in this mixture was a relatively low percentage both based on volume and an even smaller percentage based on weight.

Some of the samples which were prepared were prepared with a single direction relative motion between the gun and the collector plate. For example, the data collected with regard to those data points which are included within the solid line box at about 213 ksi were prepared from a plasma between a gun and a collector plate where a motion in the x direction, or in other words a single and first direction, attended the deposit from the plasma onto the plate. For these samples the deposit formed was a deposit having outer dimensions of approximately 5 cm $\times$12 cm due to the relative motion of the gun and the collector plate.

Other samples were prepared while there was more complex relative motion between a single gun and the collector plate. In a number of samples identified on the FIG. 8 the relative motion of gun and plate was a two directional motion. The two directions were at 90° to each other and the deposit formed was one having overall outer dimensions of approximately 15 cm$\times$15 cm.

Still other data points were made employing both a two directional relative motion between a single gun and plate and in addition a deposition angle of the plasma directed toward the plate. The data point for example identified as A is a data point where the deposition angle was 70°. The data point B was a data point where the of deposition angle was 50° and the data point C represents a point at which the deposition angle was 30°. Where the deposition angle is not identified for other data points the deposition angle is 90°.

It is readily evident with relation to the data concerning the deposition angle that there is a rapid dropoff of the strength and density properties of the samples which are measured for samples prepared with progressively lower deposition angles of the aim point of the gun relative to the gun from which the plasma originates.

With reference to the gases employed in the operation of the gun all samples were prepared using a mixture of argon and helium in the gun except where it is designated on the plot of FIG. 8 that the mixture of argon and hydrogen was used in the gun.

Turning now to the data plotted at the lower portion of FIG. 8 the samples which were prepared and from which the data were taken are the same samples as were prepared and tested in the upper portion of the figure. For example the data included within the solid line box at about 230 ksi is represented by plural data points included within the dotted box extending from about 10 to 20% (R/A). The other data points in the graph of the relationship between the percentage of ductility (approximately equivalent to R/A) and the density plotted as abscissa are measurements made on the same samples which were prepared and tested and are included in the graph at the upper portion of FIG. 8.

It is known that the best results of low pressure plasma deposition are achieved when the substrate to receive the deposit is heated to approximately 900° C. However, unless means are provided for maintaining the temperature of the receiving surface or receiving article at the preferred elevated temperature of about 900° C. the size of an article to receive a coating is limited where the only source of the heat is the heat from the plasma gun itself. Based on calculations an 80 kilowatt plasma gun can maintain a surface of about 1,000 sq. cm. heated to a temperature of about 900° C. For larger articles the article does not attain the preferred temperature and accordingly there is some danger of deficient properties in a deposit which is made because of the less than desirable temperature of the receiving surface.

However, in accordance with the present invention the formation of dense deposits on receiving surface of larger dimensions is feasible because of the use of multiple plasma guns to deposit a layer of material on the surface but also because the surface which is to receive the material is itself preferably heated to elevated temperatures which as indicated above should be of the order of at least 900° C.

EXAMPLE 1

A gun apparatus as described in reference to FIG. 1 above was employed in a chamber maintained at reduced pressure and the pattern of deposit of the layer of material from the gun was studied. Neither the gun nor the target were moved during the deposit of this Example.

The target used was a plate and the pattern of deposit of material on the plate was studied. The pattern is outlined in FIG. 2 for a first gun designated as gun A. The contour outlines of FIG. 2 are the zones in which different thicknesses of deposit were found of the sample deposit formed under the following conditions:

The powdered material used was an alloy identified as IN-100. The alloy contains the following ingredients in the following approximate concentrations: 60.5% nickel, 15% cobalt, 10.0% chromium, 5.5% aluminum, 4.7% titanium, 3.0% molybdenum, 0.06% zirconium, 1.0% vanadium, 0.014% boron, 0.18% carbon. The powder was $-400$ mesh IN-100 (less than 37 $\mu$m).

The voltage within the gun was 50 volts and the current was 1300 amperes. The gun was directed generally normal to the surface of the target and the separation of gun nozzle to target was 12½ inches.

The pressure within the vacuum chamber was 60 Torr.

No voltage was impressed from the gun to the target as the transferred arc phenomena was not employed.

The plasma gun used was a commercially available gun sold under the designation EPI, Model 03CA by the Electro Plasma, Inc. of Irvine, California.

The target employed was a sheet of copper metal having dimensions of 6 inches$\times$8 inches$\times$⅛ inch thick.

Following the plasma deposition the deposit was heated for 2 hours at 1250° C. to densify the deposited layer. Measurements were made of the density of the material both before and after the densification heating. The results of this study are illustrated in the FIG. 2.

In FIG. 2 the contour lines show the area of deposit at each thickness. The thicknesses are those marked in millimeters between the contour lines for each demarked area . The marked rectangular areas are those from which samples were taken for measurement. The fractional values listed for each rectangular area shows the density as deposited as the numerator of the fraction, and the density after densification heating for 2 hours at 1250° C. as the denominator of the fraction.

The values listed demonstrate that lower density deposits are produced at greater distances from the aim point, marked by the letter A at the appropriate aim point on the Figure.

This example teaches what is achieved by plasma spraying from a single gun aimed normal to a receiving plate. From this example it is clear that there is a serious problem of decreased density of deposit at distances from the aim point of the gun where the highest densities are achieved. Also it is clear that the low density deposits are not aided by the densification heat treatment.

EXAMPLE 2

A second gun, designated as gun B, and essentially as described in Example 1 was employed to deposit the same IN-100 material on a second target under essentially the same conditions as described in Example 1.

Figure 3:
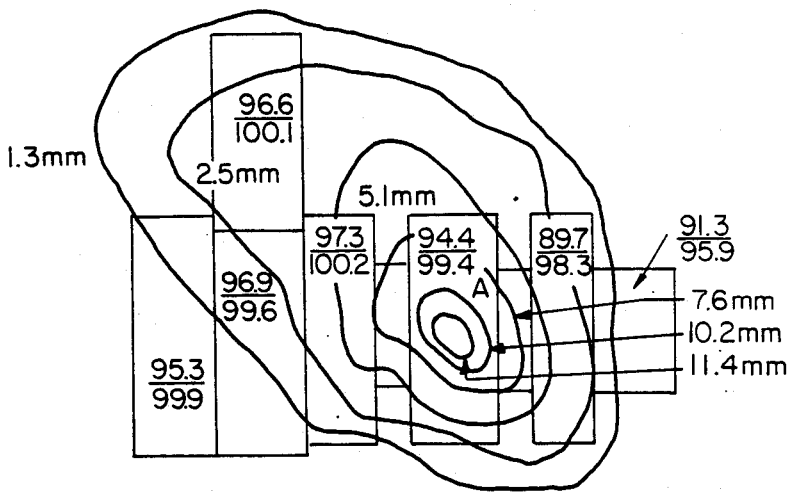
FIG. 3 is a contour map similar to that of FIG. 2.

The contour lines of the deposited material are illustrated in FIG. 3. The density values for the deposit both before and after densification heating are illustrated also on the figure in the form of fractions.

My past experience in use of guns as part of the low pressure plasma deposition of material indicates that no two EPI anodes are exactly alike and that the spray pattern from any one of them tends to change continuously during usage. This change is attributed partly to wear and erosion in the arc chamber and in the powder-feed posts and partly to individual operating characteristics of a gun. Accordingly the outer shape as well as the form of contour lines is different from one run to another even where the same gun and same target are employed.

EXAMPLE 3

Two guns, particularly the guns A and B as described with reference to Example 1 and Example 2 were both positioned in a low pressure plasma deposition chamber and were directed at a single target. The locations or aim points on the target where the gun was directed was separated by approximately 3.8 cm.

Figure 4:
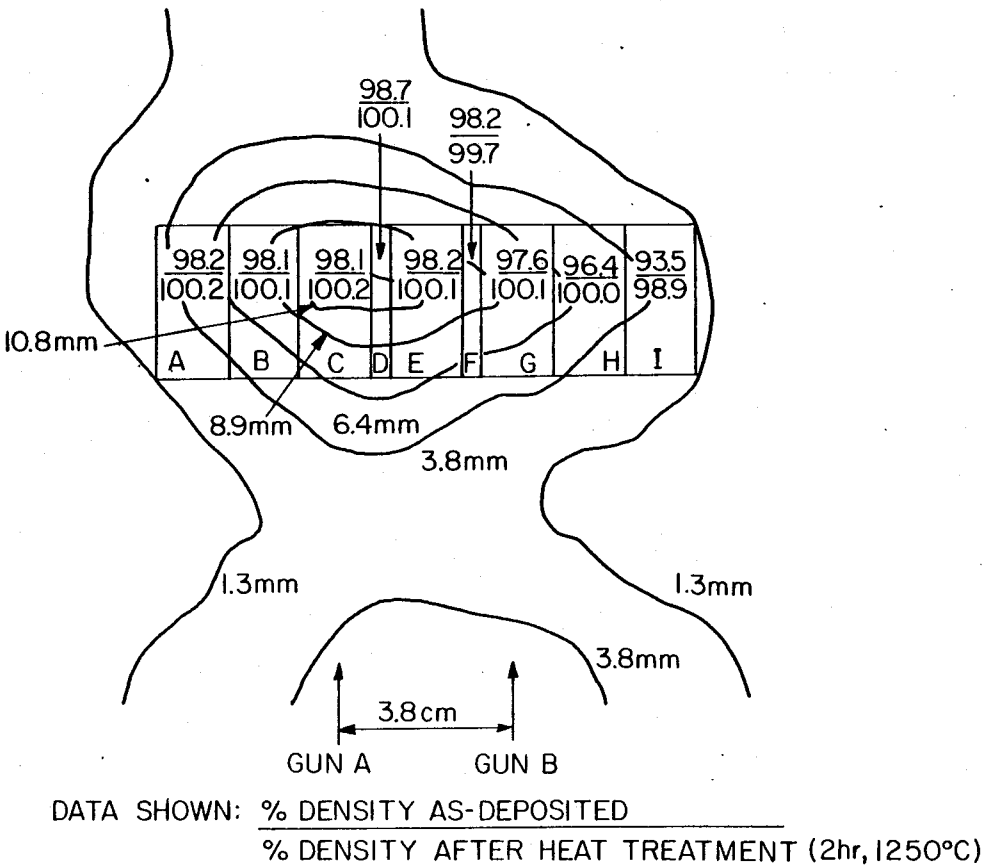
FIG. 4 is a contour map similar to that of FIG. 2 but one for a deposit made employing two guns.

The contour lines of the deposit made from the simultaneous spray with the two guns is illustrated in FIG. 4. The material deposited on the target in this Example was then heat treated for 2 hours at 1250° C. and was densified by the heating. The density of the deposit both before and after the densification heating is shown in the figure as well as shown in the earlier examples in the form of fraction values.

From the data plotted in FIG. 4 it is evident that as compared to the deposits of FIGS. 2 and 3 a substantial expanse of high density plasma spray deposit was formed by the method of this example employing the two guns aimed to deposit overlapping patterns of the sprayed product.

This result is highly unexpected because the area where high density deposit is formed is extensive and includes areas where two layers of low density material are deposited. What is surprising is that the two layers of low density deposit continue to form such an extensive combined layer and that the combined layers had high density in spite of the fact that the layers from which they were formed were low density.

EXAMPLE 4

The procedure employed in Example 3 was repeated but in this case the separation of the aim point of the two guns within the chamber was enlarged to 6.4 cm.

Figure 5:
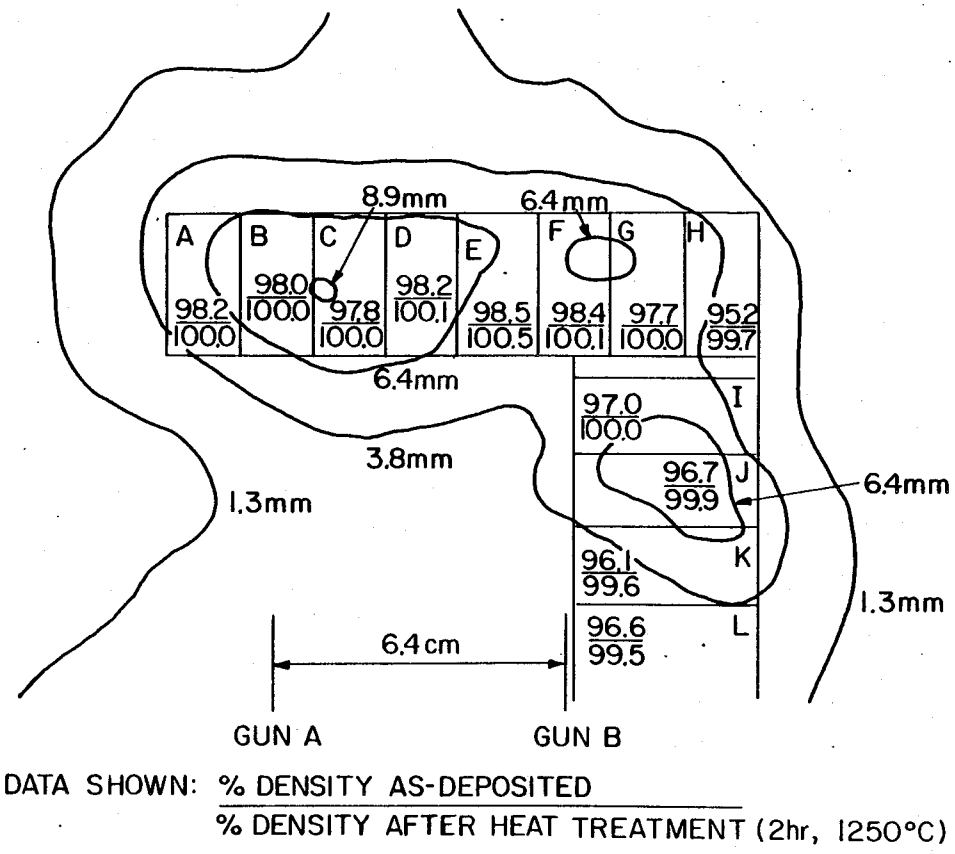
FIG. 5 is a contour map similar to that of FIG. 4.

The material was deposited and the contour lines of the deposit are illustrated in FIG. 5. Samples were taken from the deposit and the density was determined both before and after densification heating as described in Example 1. The values of density are marked in fractional form on the designated samples of the deposit as in Examples 1 and 2.

EXAMPLE 5

The procedure of Example 3 was repeated but in this case the aim point of the two guns was separated by 8.9 cm and the deposit of material was made as described above in Example 3.

Figure 6:
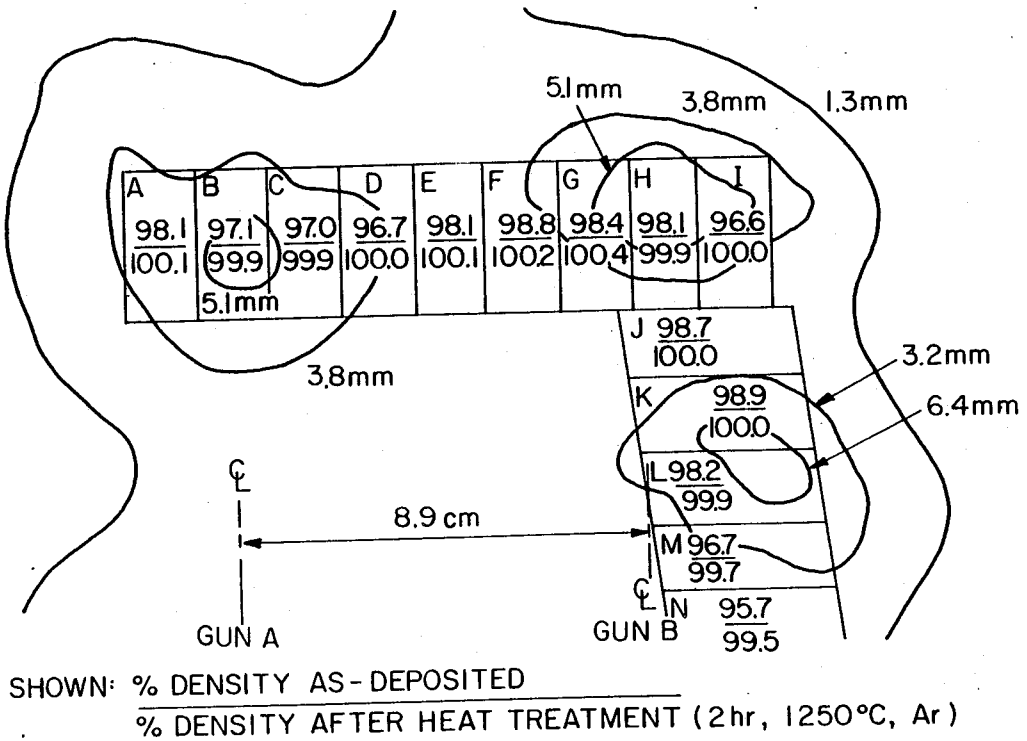
FIG. 6 is a contour map similar to that of FIG. 4.
Figure 7:
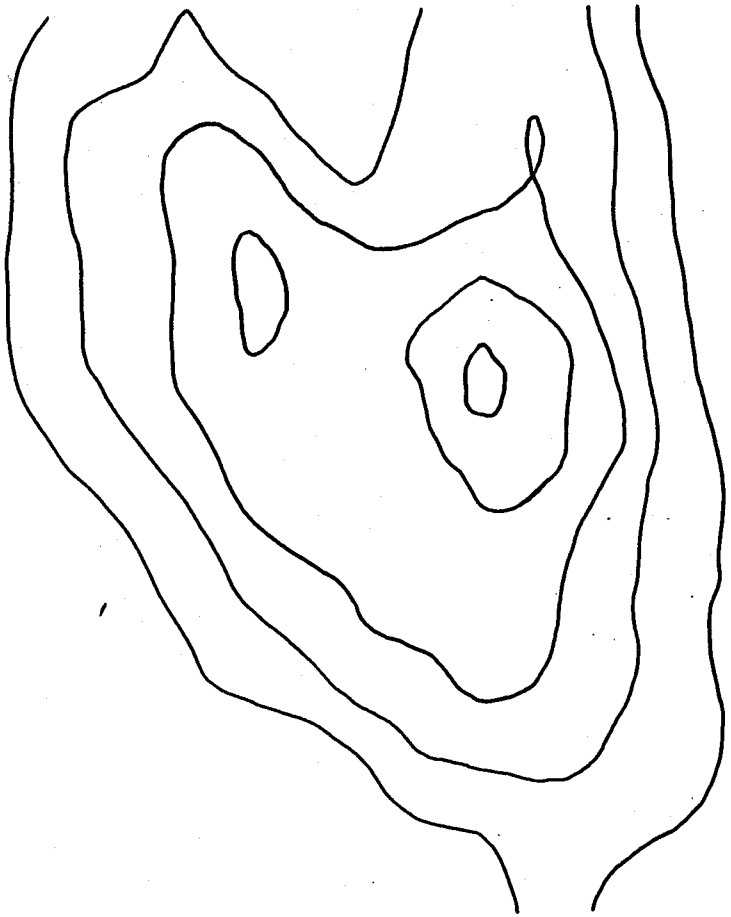
FIG. 7 is a map similar to that of FIG. 4.

A number of samples were taken from the deposit and the density of the samples both before and after densification heating was measured. The densification treatment was a two-hour treatment at 1250° C. as described in Example 1. The pattern of the deposits as indicated by contour lines is as shown in FIG. 6. Also, the density of the sample material taken from the deposit is shown in the respective areas of FIG. 6.

The results obtained from examination of the sample prepared in accordance with Example 5 revealed that the metallurgical structure of specimen cross-sections made from the target, and specifically from specimen E at the center of the target, where there was an overlap of the spray regions, produces evidence that there is a very close similarity of the metallurgical structure of the overlap region when compared to Specimens B and H of Example 5 which are located at the respective aim point regions on the target.

From an examination of the photomicrographs developed from the metallurgical microstructure of each of the specimens, the specimens are not distinguishable based on an examination of the photomicrographs because of the great similarity between them.

From the FIG. 2, it is evident that where an initial deposit of the material is made at a lower density of 92% that subsequent heating to consolidate a layer is not effective in achieving the desirable consolidation to the high density of 99 or 100%.

It should be realized that one of the advantages of the low pressure plasma deposition technique is that it permits formation of structures which have advantageous crystal and particulate properties. The heating of such materials for extended times and at very elevated temperatures can effectively diminish or destroy the beneficial crystal and related physical properties of the layer. Accordingly, attempts to consolidate the lower density portions of deposit by extended periods and higher temperature heating may cause a sacrifice in the properties of the layer not only in the less dense area but also in the fully dense portions which must be subjected to the same long-term higher temperature heating. It has been found that extensive heating of deposits that are less than 97% dense as-deposited will not result in full densification of these deposits.

From the above examples it is evident that through prior art practice a deterioration in properties accompanies the effort to apply a high density integral spray structure to a planar surface of larger dimensions than the sweet spot area in which dense plasma spray deposits are formed and that the simple heating of the deposits does not cure the density deficiency. Further it is clear that the physical properties are related to density so that a lower density deposit also means a lower strength deposit. Further it has been shown that quite surprisingly this deficiency can be overcome by the employment of two or more guns which are operated so that the lower density deposit from one gun overlays the lower density deposit from a second gun. The very surprising element here is that the lower density deposit from each of the guns in some way consolidated into a high density deposit so that planar surface structures can be built which are not otherwise feasible.

Further the movement of the guns to impart the high density spray to selected areas of a larger area surface does not overcome the low density deposit in the same fashion as the use of two guns so that efforts to spray larger areas on a planar surface employing a single gun and accompanying relative motion of the gun and receiving surface are not effective in accomplishing this desired result.

The foregoing concerns the formation of deposits on planar surfaces employing a single gun or multiple guns aimed generally normal to the surface. However, it has been found, as pointed out above and as pointed out herein, that where the angle between the gun axis and the receiving surface is less than about 70° there is a very marked decrease in the density of the deposits which are formed and there is a consequent degrading of the plasma spray deposits which are formed. The foregoing concerns the formation of the dense deposits on planar surfaces.

By simple geometry as the term is used herein is meant a plane, a strip or ribbon, sphere or other configuration generally regarded as a geometric form of simple geometry and one having no sharp corners or angles.

For purposes of this application the term plasma gun axis is the line extending through the generating portions of a gun and through the plasma to the center of the sweet spot on a receiving surface disposed normal to the axis. The plasma gun axis is shown in FIG. 1 and is labelled as such in the figure. A plasma gun axis is approximately equivalent to a gun to aim point direction.

The subject invention is particularly valuable for forming deposits on surfaces which are generally planar in configuration. Also the at least two plasma guns which are employed in forming deposits on a generally planar surface are preferably aligned parallel to each other and generally normal to the surface where the deposit is formed.

However the alignment of the guns to each other need not be totally parallel and the alignment of the guns to the surface need not be totally normal. For example it is evident from the data given above that a gun can be aligned to an angle of about 70° to a surface and still give a dense deposit. However the deposits themselves and particularly the areas of the deposits must overlap in order to obtain the advantages of having two lower density regions of the deposit combine into a high density region in accordance with the subject invention.

Also, the gun alignment need not be totally parallel to each other inasmuch as deposits can be formed with either one or both guns angled up to about 20° from a normal position, that is, at an angle of greater than 70° to the surface.

Moreover, the surface on which the deposit is formed need not be totally planar and may have some irregularities or undulations if the extent of the irregularities does not present a surface to the plasma gun which is angled at less than 70° to the aim direction of the gun or the gun axis. As noted above, a gun axis as used herein is taken to be a line which extends through the portion of the gun where the plasma is generated and extends from the gun muzzle to the surface where a plasma deposit is formed by the gun and particularly to the center of the sweet spot of the deposit.

Also, it is possible for a set of two guns which are used in forming a deposit on a receiving surface to form the deposit although the surface itself is not totally planar. For example, the surface may be the intersection of two planes along an open fold or shallow valley. Such a surface may be characterized as having a dihedral angle. Webster's Dictionary defines a dihedral angle as a "figure formed by two intersecting planes."

Where the two guns which are employed are parallel one to the other and the dihedral angle is not greater than 20° from planar, then the method of the present invention will form a deposit which has the beneficial characteristics which have been discovered and found to be produced in a manner more fully described above. As the term "substantially planar" is employed herein it includes surface which has a dihedral angle of less than 20% or surface irregularities or undulations which on an overall basis are not greater than a dihedral angle of about 20° from planar.

What is claimed is:

1. The method of forming a dense deposit over an extended substantially planar receiving surface which comprises providing a low pressure plasma deposit apparatus to contain at least two plasma spray guns, supplying a plasma spray powder material to each gun for plasma spray from said gun, directing a first plasma gun at a first aim point on said receiving surface to deposit material processed through said first gun onto said receiving surface, directing a second plasma gun at a different aim point of said receiving surface to deposit like material processed through said second gun onto said surface said aim points being separated by a distance greater than the distance from an aim point to a point on said receiving surface of low density deposit from either of said guns, overlapping the deposits in the regions of low density and maintaining the angle of incidence of said guns to said surface substantially normal.

2. The method of claim 1 wherein the receiving surface is predominantly planar.

3. The method of claim 1 wherein the receiving surface is of simple geometry.

4. The method of forming a dense body of a plasma spray deposit providing a finely divided powder of the composition of the body, supplying the powder simultaneously to two or more plasma guns in a low pressure chamber, plasma spraying the powder onto a substantially planar receiving surface in said low pressure chamber, and directing the guns to cause the spray pattern deposit of said guns to overlap.

5. The method of claim 4 in which the aim angle of the two or more guns are all at more than 70° to the receiving surface.

6. The method of claim 4 in which the surface to receive the deposit is of simple geometry.

* * * * *